United States Patent [19]

Renner et al.

[11] 4,315,804

[45] Feb. 16, 1982

[54] SHED STRUCTURE FOR A SET OF COKE OVENS

[75] Inventors: Kurt Renner, Bochum-Stiepel; Ernst Langer, Oer-Erkenschwick; Werner Eisenhut, Essen, all of Fed. Rep. of Germany

[73] Assignee: Bergwerksverband GmbH, Essen, Fed. Rep. of Germany

[21] Appl. No.: 143,305

[22] Filed: Apr. 24, 1980

[30] Foreign Application Priority Data

Jan. 3, 1980 [DE] Fed. Rep. of Germany ..... 3000064

[51] Int. Cl.[3] ..... C10B 33/00; C10B 41/02

[52] U.S. Cl. ..... 202/263

[58] Field of Search ..... 201/39; 202/222, 263; 98/115 R, 115 LN, 115 SB, 115 VM; 55/319

[56] References Cited

U.S. PATENT DOCUMENTS

| | | | |
|---|---|---|---|
| 3,879,267 | 4/1975 | Nashan et al. | 202/263 |
| 3,930,961 | 1/1976 | Sustarsic et al. | 202/227 |
| 3,937,656 | 2/1976 | Pries et al. | 202/263 X |
| 3,966,563 | 6/1976 | Armour et al. | 202/263 X |
| 3,972,782 | 8/1976 | Patton | 55/319 X |
| 4,113,569 | 9/1978 | Mahar | 202/263 X |

FOREIGN PATENT DOCUMENTS

| | | | |
|---|---|---|---|
| 2326630 | 12/1974 | Fed. Rep. of Germany | 202/263 |
| 1455025 | 11/1976 | United Kingdom | 202/263 |

*Primary Examiner*—Bradley Garris

*Attorney, Agent, or Firm*—Michael J. Striker

[57] ABSTRACT

The shed or hall for a set of coke ovens defining a door region for supporting a coke transfer carriage, a quenching region for supporting a quenching carriage, and a washer region, comprises a central upright partition disposed between the quenching and washer regions and having its top portion bent about 180° to form a guiding surface communicating with the washer region, a roof supported above the respective regions and accommodating an upper guiding metal sheet and an intermediate metal sheet forming together with the guiding top portion of the upright partition two (2) fume discharging channels communicating respectively with the door region and the quenching region and at the other end, with the washer region.

12 Claims, 1 Drawing Figure

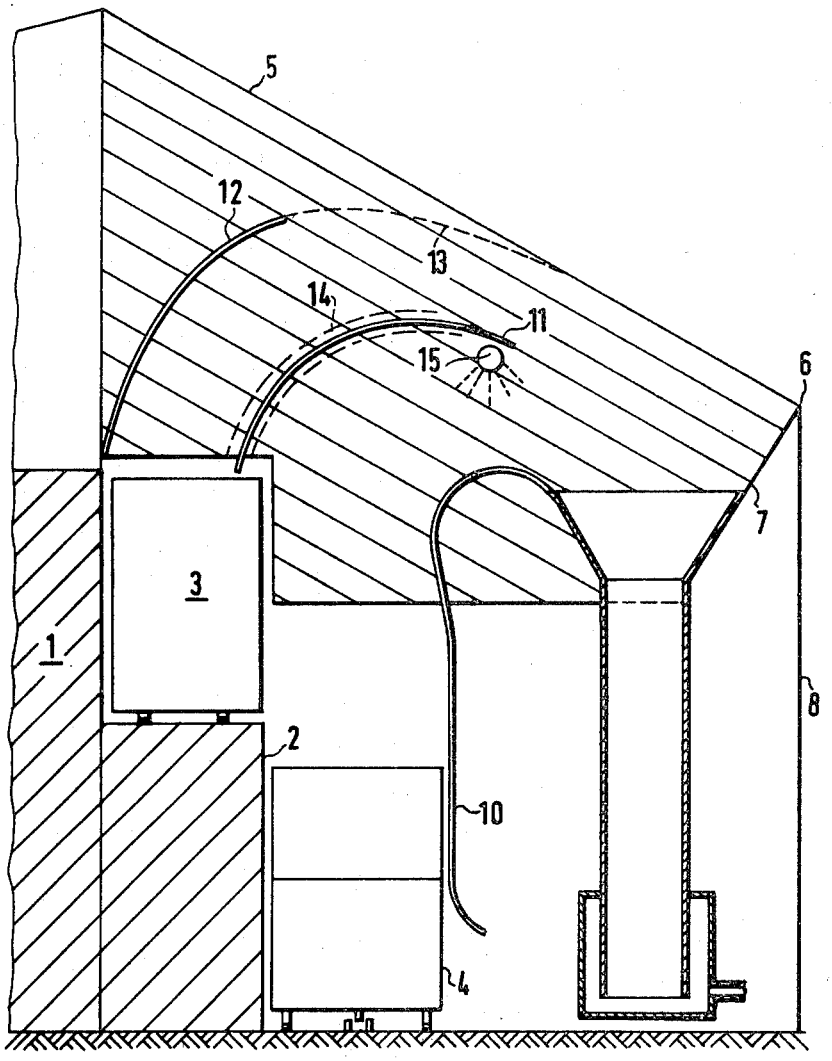
5
12
13
14
11
15
6
7
3
1
8
2
10
4

SHED STRUCTURE FOR A SET OF COKE OVENS

BACKGROUND OF THE INVENTION

The present invention relates in general to coking ovens and in particular it relates to a shed structure for discharging gases and vapors released during the discharge of coke from a set of coke ovens, the sets including a door region for coke transfer carriages, a quenching region communicating with the door region and a washer region arranged behind the quenching region.

Many designs of sheds for a range of coke ovens are known in which the emissions from the coke ovens are sprayed with water and washed in special washers whereupon the purified gases are discharged by means of blowers into the outer atmosphere. In such known designs, however, the crude fumes or gases usually dam up in the roof region of the sheds and make the sojourn in the shed intolerable.

SUMMARY OF THE INVENTION

It is a general object of the present invention to overcome the aforementioned disadvantages.

More particularly, it is an object of the invention to provide an improved shed for coke oven sets in which the crude gases which particularly upon lifting of the oven doors and upon discharging of the coke cake are released and are completely discharged from the shed in a purified form without the occurrence of the aforementioned disturbances.

In keeping with these objectives and others which become apparent hereafter, one feature of the invention resides, in a shed structure for coke oven sets defining a door region for coke transfer carriages, a quenching region, and a washer region, in the provision of an upright support arranged behind the washer region, a roof resting on the support and terminating above the door region to define a roof space above respective regions, and upright partition arranged between the quenching region and the washer region and extending approximately to the height of the ovens, the top portion of the partition being bent by about 180° to form a guiding surface of a substantially semi-circular cross section communicating with the inlets of respective washers, a curved upper guiding member extending in the roof space parallel with the curved top portion of the upright partition and being connected at one and thereof to the top edge of the ovens in the door region and at the other end thereof terminating in the washer region above the partition, and an intermediate guiding member extending in the roof space, one end of the intermediate guiding member starting at the upper front edge of the transfer carriages in the door region and the other end terminating in the washer region above the partition.

By virtue of the present invention, a shed for a set of coke ovens is obtained which has a particularly favorable configuration from the point of view of fluid flow technology and consequently high washing speed is attained and purified gas can be readily discharged by subsequent blowers while no damming up or whirling movements of crude gases and vapors under the shed roof take place and no disadvantageous effects occur.

The spraying and washing of crude fumes in a washer as well as the discharge of the purified gases by means of a blower are known, for example, from the German Pat. No. 2,306,057 and consequently no detailed description of this respect is necessary.

The flow conditions for the discharge of crude gases can be substantially improved by an inlet channel formed at the bottom portion of the upright partition in the shed, the clearance of the channel being about up to half of the quenching carriage and the upper edge of the opening being bent into the washer region. Furthermore, the curved guiding surface formed by the top portion of the partition is slightly bulged into the quenching region. This slight bulging is particularly effective for achieving interference-free discharge of crude gases. Contrary to the opinion expressed for example in the periodical, "Metal-Producing", February, 1979, page 47, and in U.S. Pat. No. 3,972,782 the bulging part of the partition between the quenching and washer regions must not be provided with any projecting nose inasmuch the latter would cause considerable change in the laminar flow and would cause turbulences of crude gas under the shed roof and consequently the streamline discharge of the gas would become more disturbed than improved.

The bending of the upper edge of the opening in the partition which is made approximately half way of the height of the quenching carriage forwardly affects the formation of the air stream channel and contributes to an unobstructed and accelerated intake of fresh air into the lower range of the mostly open interior of the shed.

In general, the lateral end walls of the shed, if possible, should be fully closed in order to prevent strong winds from affecting the working conditions in the shed. It is evident that winds when blowing laterally into the shed or hall structure would disturb the sensitive flow conditions necessary for interference-free discharge of crude gases.

In order to mitigate this danger, there are provided additional partitions in the roof space of the shed or hall structure each extending below the top part of respective ovens and of the upright partition to divide the upper half of the shed into a plurality of sections. These additional partitions are provided with curved slots or cutouts for accommodating the intermediate guiding member. Preferably, these partitions are spaced apart one from the other about the extent of five to ten ovens and form together with the guiding sheet metals curved discharge channels of a substantially rectangular cross-section which contribute to a whirl-free and accelerated discharge of crude gases. In order to save on washers and blowers it is recommendable to employ a single washer and a blower for a larger number of consecutive coke ovens. In addition, it may suffice when several washers are assigned to a single blower.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The single FIGURE is a schematic sectional side view of a shed or hall structure for a set of coke ovens according to this invention.

DESCRIPTION OF THE PREFERRED EMBODIMENTS

Reference numeral 1 designates a cross-section of a set of consecutive coke ovens defining in their oven door region a ramp 2 which supports a coke transfer carriage 3 by means of which the discharged coke is transferred into quenching carriage 4 which is movable in a quenching carriage region adjoining the ramp 2 and leading into a non-illustrated quenching zone.

The hall or shed roof 5 has its top side loosely or rigidly connected to the uppermost edge of the oven block 1 and slopes to point 6 where it is supported by a fully-closed lateral wall 7 and an open front wall or pillar 8.

Closed lateral wall 7 is gas tightly connected to washer region 9. A non-illustrated blower is arranged outside the shed behind the pillar 8 for discharging the purified gases from the washer region.

The upright partition 10 is provided between the quenching carriage region and the washer region, and has its top portion bent about 180° to adjoin the inlet of the washer 9. An intermediate curved guiding metal sheet 11 is arranged in the roof space above the quenching carriage region. One end of the guiding sheet 11 is directed above the outer top edge of the coke transfer carriage 3 whereas the opposite end of the sheet 11 terminates above the curved top portion of the partition 10. An upper guiding sheet metal 12 is arranged in the roof space above the intermediate sheet metal 11 and has its lower end connected to the front top edge of the oven set 1. The top end portion of the guiding sheet metal 12 is indicated by dashed line 13 where the guiding metal sheet 12 transits into the inner surface of the roof 5. As a result, the roof can be designed very low and overlaps the oven cover by from 3 meters up to a maximum 4½ meters. Due to the dimensioning of the shed roof, the height of the particular distance of the roof from the top of the door region corresponds approximately to the distance between the oven doors and the intermediate or upright partition 10 and consequently favorable static conditions of the whole structure will result. The hatched area in the roof space adjoining the lateral wall 7 represents separating partitions provided with cutouts or slots 14 for passing the intermediate guiding metal sheet 11. These cutouts 14 can be omitted in the case when guiding sheet 11 is firmly installed on the respective separating partitions. In the event when the guiding metal sheet 11 is mounted on the front edge of the coke transfer carriage 3, the separating partitions are spaced apart about the width of 5 to 10 coke ovens and the guiding sheet 11 travels together with the transfer carriage 3 along the oven doors on the ramp 2. The intermediate guiding metal sheet 11 forms always at the time of the discharge of the coke cake from a particular oven a first or upper discharge channel of a substantially rectangular cross-section which is further bounded by the upper guiding sheet 12 and the adjoining separating partitions; the upper discharge channel communicates with the door region above the transfer carriage 3 and with the washer region above the curved top of the partition 10. Another discharging channel of a substantially rectangular cross-section is formed between the intermediate metal sheet 11 and the top surface of the bent portion of the partition 10 and this second channel communicates with the quenching region above the carriage 4 and at the other end with the washer region below the outlet of the upper discharge channel. By virtue of the two superposed discharge channels the flow of crude gases and vapors is accelerated. These favorable flow effects are further aided by the gradual reduction of the distance between the guiding metal sheets 11 and 12. It will be noted that the width of the partition 10 as well as of the guiding metal sheet 12 corresponds to the length of the hall or shed structure. In order to improve the discharge of polluting substances emitted from the ovens, there is provided also a water nozzle 15 directed into the washer region 9. Additional water nozzles can also be provided in accordance with the teaching of the German Pat. No. 2,306,057.

For a further improvement of the flow characteristics it is recommendable that the distance between the intermediate guiding metal sheet 11 and the guiding top surface of the central, upright partition 10 be gradually reduced so that the apex point of the curved top portion of the partition 10 and the end point of the guiding metal sheet 11 be at most about B times 0.75 where B denotes the distance between the outer edge of the ramp 2 and the upright central partition 10.

It will be understood that each of the elements described above, or two or more together, may also find a useful application in other types of constructions differing from the types described above.

While the invention has been illustrated and described as embodied in the hall structure for use with coke ovens, it is not intended to be limited to the details shown, since various modifications and structural changes may be made without departing in any way from the spirit of the present invention.

Without further analysis the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A hall structure for discharging polluting substances such as dust particles, gases and vapors released during the discharge of coke from a set of coke ovens and escaping from the oven doors, the set including a door region for a coke guide transfer carriage, said transfer carriage having an inner top edge facing said ovens and an outer top edge remote from said ovens, a quenching carriage region communicating with the door region and a washer region arranged behind and being spaced apart from the quenching carriage region as viewed from the door region, said structure comprising supporting means adjoining said washer region, a roof resting on the supporting means and terminating at said ovens above the door region to define a roof space above the respective regions, an upright central partition arranged between said quenching carriage region and said washer region and extending approximately up to the height of said ovens, the top portion of said partition being bent by about 180° to form a guiding surface over a substantially semicircular cross-section communicating with the inlet of said washer region, a curved upper guiding member extending in said roof space parallel with said top portion of the partition and being connected at one end to the top edge of said ovens in said door region in the range of said inner top edge of said transfer carriage and at the other end terminating in said washer region above said partition, and an intermediate guiding member extending in said roof space, one end of said intermediate guiding member starting in the range of the outer top edge of said transfer carriage in the door region and the other end terminating in said washer region above said partition.

2. A structure as defined in claim 1, further including a water nozzle arranged at the other end of said intermediate guiding member and being directed into said washer region to entrain polluting substances discharged from said door region into said washer region.

3. A structure as defined in claim 1, wherein said one end of said intermediate guiding member is attached to said outer top edge of said transfer carriage.

4. A structure as defined in claim 1, wherein said intermediate guiding member is attached to said roof.

5. A structure as defined in claim 1 wherein said central upright partition has in its lower region an opening extending approximately half way to the height of the quenching carriage to form an air intake channel with the latter, the upper edge of said opening being bent in the direction toward said washer region.

6. A structure as defined in claim 5 wherein the curved top portion of said central partition is slightly bulged toward said coke oven set.

7. A structure as defined in claim 6 wherein said upper guiding member merges into the inner surface of said roof.

8. A structure as defined in claim 1 wherein the height of said roof space above said door region of said ovens corresponds approximately to the distance between the oven doors and the central upright partition.

9. A structure as defined in claim 1 wherein the clearance between the upper guiding member and the intermediate guiding member decreases in the direction toward said washer region approximately about 10%–40%.

10. A structure as defined in claim 1 wherein said space is separated by a plurality of separating partitions extending in alignment with the side walls of respective coke ovens.

11. A structure as defined in claim 10 wherein said separating partitions are provided with cutouts for accommodating said guiding members.

12. A structure as defined in claim 10 wherein said separating partitions are spaced apart one from the other about a distance of 5–10 ovens.

* * * * *